US007028347B2

(12) United States Patent
Sanderson

(10) Patent No.: US 7,028,347 B2
(45) Date of Patent: Apr. 18, 2006

(54) DIGITAL ELECTRONIC VOLUME/FLOW CONTROL SENSOR TOILET

(76) Inventor: Dilworth D. Sanderson, 848 East 214th St., Bronx, NY (US) 10467

( * ) Notice: Subject to any disclaimer, the term of this patent is extended or adjusted under 35 U.S.C. 154(b) by 0 days.

(21) Appl. No.: 11/116,315

(22) Filed: Apr. 28, 2005

(65) Prior Publication Data

US 2006/0041999 A1 Mar. 2, 2006

Related U.S. Application Data

(60) Provisional application No. 60/606,368, filed on Sep. 1, 2004.

(51) Int. Cl.
*E03D 1/14* (2006.01)

(52) U.S. Cl. ..... 4/313; 4/324; 4/333; 4/406; 4/DIG. 3

(58) Field of Classification Search ..... 4/313, 4/324, 325, 333, 366, 367, 406, DIG. 3
See application file for complete search history.

(56) References Cited

U.S. PATENT DOCUMENTS

| | | | | |
|---|---|---|---|---|
| 1,456,196 A | * | 5/1923 | Staats | 4/406 |
| 2,717,396 A | | 9/1955 | Chiles | 4/367 |
| 3,505,689 A | | 4/1970 | Neff et al. | 4/367 |
| 3,908,204 A | | 9/1975 | Hopkins | 4/406 |
| 3,965,492 A | | 6/1976 | Hendricks | 4/422 |
| 4,055,864 A | | 11/1977 | Liu et al. | 4/253 |
| 4,176,395 A | * | 11/1979 | Evelyn-Veere et al. | 700/284 |
| 4,185,337 A | | 1/1980 | Sargent et al. | 4/300 |
| 4,306,321 A | | 12/1981 | Norlin | 4/321 |
| 4,392,260 A | | 7/1983 | Bensen | 4/324 |
| 4,908,886 A | | 3/1990 | Barrett, Sr. et al. | 4/325 |
| 4,918,764 A | | 4/1990 | Haselswerdt et al. | 4/406 |
| 4,989,277 A | | 2/1991 | Tsutsui et al. | 4/367 |
| 5,036,553 A | | 8/1991 | Sanderson | 4/313 |
| 5,052,060 A | | 10/1991 | Makita et al. | 4/300 |
| 5,133,089 A | | 7/1992 | Tsutsui et al. | 4/300 |

(Continued)

FOREIGN PATENT DOCUMENTS

EP 0 165 407 A2 12/1985

(Continued)

OTHER PUBLICATIONS

Internet article entitled "Green Culture Water Conservation", http://www.watersavers.com/docs/watersavertoilet main.shtml, 1 page retrieved Dec. 27, 2004.

*Primary Examiner*—Robert M. Fetsuga
(74) *Attorney, Agent, or Firm*—Richard C. Litman

(57) ABSTRACT

A digital electronic volume/flow control sensor toilet includes a bowl, a water storage tank interconnected with the bowl, and a digital electronic volume/flow control sensor flushing mechanism. The flushing mechanism has components including a volume sensor, a shuttle, a plunger assembly, a motor, a water valve, and a control with a power source and volume/flow control sensor circuitry communicatively interconnecting the components. The volume sensor has a plurality of electrically conductive contact points exposed on a surface and at positions along a length of the side of the volume sensor with a recess, the positions of the contact points corresponding to predetermined volume levels of the flushing mechanism. A plurality of VOLUME SELECTION buttons/switches are mounted on an outer surface of the water storage tank, the VOLUME SELECTION buttons/switches being associated with the contact points. A HOLD button/switch can be mounted on the outer surface of the water storage tank.

16 Claims, 8 Drawing Sheets

U.S. PATENT DOCUMENTS

| | | | | |
|---|---|---|---|---|
| 5,432,959 | A | 7/1995 | Ellsworth et al. | 4/406 |
| 5,535,781 | A | 7/1996 | Paterson et al. | 137/624.11 |
| 5,603,127 | A | 2/1997 | Veal | 4/246.1 |
| 5,731,758 | A | 3/1998 | Suttlemyre et al. | 340/612 |
| 5,732,417 | A | 3/1998 | Pondelick et al. | 4/427 |
| 5,913,611 | A | 6/1999 | Jaeckels et al. | 4/325 |
| 5,937,455 | A | 8/1999 | Donati | 4/665 |
| 6,018,827 | A | 2/2000 | Shaw et al. | 4/664 |
| 6,058,519 | A | 5/2000 | Quintana | 4/427 |
| 6,178,569 | B1 | 1/2001 | Quintana | 4/427 |
| 6,349,921 | B1 | 2/2002 | Jahrling | 251/129.04 |
| 6,536,053 | B1 | 3/2003 | Icking et al. | 4/367 |
| 6,604,249 | B1 | 8/2003 | Han et al. | 4/410 |
| 6,637,041 | B1 | 10/2003 | Gutierrez et al. | 4/325 |
| 6,640,351 | B1 | 11/2003 | Diaz-Perez | 4/325 |
| 6,647,559 | B1 | 11/2003 | Lee | 4/354 |
| 6,651,263 | B1 | 11/2003 | Hsiao et al. | 4/326 |
| 6,671,894 | B1 | 1/2004 | Sigrist | 4/427 |
| 6,675,398 | B1 | 1/2004 | Antunez | 4/366 |
| 6,691,332 | B1 | 2/2004 | Khoo | 4/325 |
| 6,782,564 | B1 | 8/2004 | Cheng | 4/434 |
| 6,785,913 | B1 | 9/2004 | Ho | 4/325 |
| 6,810,902 | B1 | 11/2004 | Bootka | 137/312 |
| 2003/0066125 | A1 | 4/2003 | Guler | 4/405 |
| 2004/0040079 | A1 | 3/2004 | Snyder | 4/406 |
| 2004/0194824 | A1 | 10/2004 | Guler et al. | 137/269 |

FOREIGN PATENT DOCUMENTS

| | | | |
|---|---|---|---|
| EP | 0 228 909 | A2 | 7/1987 |
| ES | 2 208 032 | A1 | 6/2004 |
| FR | 2 601 709 | A1 | 1/1988 |
| FR | 2 615 014 | A1 | 11/1988 |
| FR | 2 261 891 | A1 | 4/1993 |
| GB | 1 560 617 | | 2/1980 |
| GB | 2 194 259 | A | 3/1988 |
| GB | 2 245 288 | A | 1/1992 |
| JP | 3-275825 | A | 12/1991 |
| JP | 4-124333 | A | 4/1992 |

* cited by examiner

DIGITAL ELECTRONIC VOLUME/FLOW CONTROL SENSOR TOILET

CROSS-REFERENCE TO RELATED APPLICATION

This application claims the benefit of U.S. Provisional Patent Application Ser. No. 60/606,368, filed Sep. 1, 2004, which is incorporated herein by reference.

BACKGROUND OF THE INVENTION

1. Field of the Invention

The present invention relates generally to toilets and, more particularly, to a digital electronic volume/flow control sensor toilet.

2. Description of the Related Art

Toilets are well known and all involve flushing mechanisms to pass waste down a drain. Toilets typically include a bowl through which water passes to receive and remove matter, and a water storage tank interconnected with the bowl to replenish water after the flushing has emptied the bowl. Typical flushing mechanisms include a flush handle interconnected with a float, a flapper valve, and a water-stop valve. When the flush handle is pressed, the flapper valve opens and releases water from the water storage tank into the toilet. The float drops and water starts to refill the water storage tank immediately. As the level of water in the water storage tank rises, the float also rises and eventually shuts off the water-stop valve, preventing any more water from entering the water storage tank.

Leaks typically occur when the rubber seal around the flapper valve deteriorates due to aging and corrosion. The resulting leak, which may go undetected for a long period of time, causes water to drain slowly into the toilet bowl, leading to increased water bills for consumers. Leaks also occur because the force from the rising float may not be enough to engage the water-stop valve. This situation, which also may go undetected for a long period of time, happens when the float is aged and the pivot mechanism develops fractures due to deposits. If the water-stop valve is not activated, the water in the water storage tank will leak through the stand-up tube into the toilet. Leaks also occur when the water storage tank is damaged. This situation is easily detected easily since the floor around the toilet becomes wet. Leaks also occur when the water-stop valve malfunctions. In this situation, water continues leaking into the water storage tank until the water-stop valve is replaced.

If a leak remains undetected for a long period of time, a substantial amount of water can be wasted and extensive water damage may occur. This situation can be even worse in hotels or motels, where some toilets are not frequently used. Modifications to current flush systems have been proposed to eliminate these types of leaks including a latch attachment for float-operated valves, a tank ballcock with a detent arm, and a dual-valve control system. For each of these modifications, water is not allowed into the tank until the flush system is activated. If a leak exists in any component, water leaks out of the tank but no water is allowed to flow into the water storage tank.

A latch attachment for float-operated valves includes a hanging pendulum added to the float arm to fix the arm and hold the water-stop valve closed until the flush handle is pressed. Although this modification is technically feasible, proper installation of the latch attachment is almost impossible. In particular, when the water level in the water storage tank changes due to a leak, the pendulum is not able to keep the valve in the shut-off position. Furthermore, the latch attachment cannot be applied to other flush systems.

A tank ballcock modification includes an adjustable arm that is pivotally hinged above a ballcock float system. The adjustable are swings into a latching position below the float when the float is at its top position, thereby preventing the float from lowering until the flush handle is activated. The tank ballcock modification seems effective, but it requires adjustments because of different water shut-off levels. In this modification, the user must press the flush handle until the float lowers completely, and because of the weight of the tank ballcock modification, a user feels a heavy resistance on the handle during the flushing operation. The tank ballcock modification cannot be applied to other flush systems.

A dual-valve control system modification includes the water-stop valve at the top of the water storage tank, and a pin valve added to the bottom of the stand-up tube. When the flush handle is pressed, a small activating pin pushes down on one end of a pivot mechanism, and the other end of the pivot mechanism opens the pin valve. Water flows into the stand-up tube, pushes up a weight saddle, and starts to fill the tank. When the water reaches the shut-off level, the top valve closes and the water stops flowing into the stand-up tube. The weight saddle then sinks, pushing the pin valve back to the shut-off position and completing the operation. If the pin valve is not activated, water flow into the tank is always stopped, reducing the likelihood of a leak in this modification.

Although conceptually sound, the dual-valve modification must address a number of practical problems. When the bottom pin valve is activated, water can travel up the hose of the activating pin to the flush handle and leak out of the water tank. The stroke of the activating pin is critical. If it is too short, it won't be able to open the pin valve, and if it is too long, it generates a reaction force that eventually damages both the pin valve and the mounting area of the activating pin. Designing a mechanism to control this stroke increases the manufacturing cost and requires adjustments during and after installation. The base diameter of the stand-up tube must be enlarged to accommodate the pivot mechanism. A larger stand-up tube may not fit well in a variety of flush systems. Furthermore, the pivot mechanism may become clogged after long periods of use, and because of the weight of the dual-valve modification, the user may feel a heavier resistance than with a regular flush system.

Therefore, a need exists for a digital electronic volume/flow control sensor toilet that successfully inhibits water storage tank leaks and optimizes manufacturing, installation, operation, reliability, and/or adaptability factors.

SUMMARY OF THE INVENTION

The present invention is a digital electronic volume/flow control sensor toilet. The digital electronic volume/flow control sensor toilet includes a bowl through which water passes to receive and remove matter, a water storage tank interconnected with the bowl to replenish water after the flushing has emptied the bowl, and a digital electronic volume/flow control sensor flushing mechanism. The digital electronic volume/flow control sensor flushing mechanism has digital electronic volume/flow control sensor components including a volume sensor, a shuttle, a plunger assembly, a motor, a water valve, and a control with a power source and digital electronic volume/flow control sensor circuitry communicatively interconnecting the digital electronic volume/flow control sensor components.

The flushing mechanism has a container preferably configured in the form of a generally rectangular box with a lower end, an upper end and four sides interconnecting the lower end and upper end. The ends and sides are preferably formed of a durable, water resistant material, such as plastic or the like. The material may be transparent, translucent and/or opaque with coloring as desired. The lower end of the container has a generally circular aperture defined therein with a generally cylindrically threaded end protruding therefrom. The threaded end is configured to releasably engage with a threaded anchor nut interconnected with the water storage tank of the digital electronic volume/flow control sensor toilet.

The volume sensor is an elongated generally rectangular element with an upper end, a lower end, two sides, and an elongated recess on one of the two sides. The lower end of the volume sensor has a footing removably attachable to the lower end of the container of the flushing mechanism by appropriate fasteners which may be screws, nails, tacks, bolts, nuts, adhesives, or the like. A plurality of electrically conductive contact points are exposed on the surface and along the length of the side of the volume sensor with the recess. Positions of the contact points correspond to predetermined volume levels of the container. A plurality of VOLUME SELECTION buttons/switches can be associated with the contact points and are mounted on the outer surface of the water storage tank of the toilet. These VOLUME SELECTION buttons/switches may include appropriate indicia in the form of alphanumeric characters, icons, symbols, etc., and may be provided with a desired color and/or Braille to accommodate particular users.

An additional HOLD button/switch can also be mounted on the outer surface of the water storage tank. The HOLD button/switch, when activated by a user in combination with one of the VOLUME SELECTION buttons/switches, causes water to fill the container to the volume associated with the selected VOLUME SELECTION button/switch. Electrical leads are interconnected to the contact points and are sealed within the volume sensor. These electrical leads pass through and emerge from the top of the volume sensor. The volume sensor passes through the shuttle. As an alternative to the volume selection button/switch and hold button/switch, a load sensor can be interconnected with the volume sensor to automatically sense a load and cause water to fill the container of the flushing mechanism to the volume associated with the amount of load sensed by the load sensor.

The shuttle is configured to slidably move up and down along the volume sensor via appropriately shaped apertures defined through the top and bottom of the shuttle. The shuttle is preferably made of a water resistant, easily floating material. The apertures are configured to effectively mesh with the contour of the volume sensor. The shuttle includes a spring-type electrically conductive brush that makes constant contact with the surface of the volume sensor as the shuttle moves up and down the volume sensor. An electrical lead is interconnected with the brush. When the container is empty, the shuttle rests at the bottom of the volume sensor. When water fills the container, the shuttle moves up and floats on the surface of the water. When the shuttle passes each of the contacts on the volume sensor, a signal corresponding to volume levels associated with the contacts is provided to the digital electronic volume/flow control sensor circuitry in the control.

The plunger assembly is an elongated rod with a top end and a bottom end. The rod is preferably made of durable material, such as metal, plastic, or the like. A water sealing plunger element is attached to the bottom end of the rod. The water sealing plunger element is preferably made of flexible water resistant material, such as rubber or the like. A straight gear ratchet is attached to the top end of the rod and is configured to interact with a gear on the motor. The plunger assembly moves up and down and causes the plunger element to open and close the circular aperture at the lower end of the container. When the plunger element is open the container release any water contained therein, and when the plunger element is closed the container can be filled with water.

The motor is preferably a reversible DC electric motor, such as six volts or the like. The motor has two ends with a rotatable shaft extending from one end with a gear attached thereto. Wiring is attached to the other end and is configured to electrically interconnect the motor with a power source. When the shaft rotates in the clockwise direction, the gear on the output shaft causes the gear ratchet on the plunger assembly to move up, thereby opening the plunger element. When the shaft rotates in the counter-clockwise direction, the gear on the output shaft causes the gear ratchet on the plunger assembly to move down, thereby closing the plunger element. The motor may be configured with predetermined settings to stop the motor when the gear on the output shaft rotates a predetermined amount in the clockwise direction and/or when the output shaft rotates a predetermined amount in the counter-clockwise direction. These particular settings may be varied as desired.

The water valve is preferably a DC electric water valve. The water valve is electrically interconnected with the VOLUME LEVEL buttons and/or switches on the outer surface of the water storage tank. The control includes digital electronic volume/flow control sensor circuitry and a power source. The power source may be a chargeable and/or non-chargeable battery. Alternatively, the control may be configured for receiving power from an external power source, such as utility power, and converting such power to a DC voltage level suitable for driving the components in the digital electronic volume/flow control sensor circuitry.

When one of the VOLUME LEVEL buttons on the water storage tank is activated, the control causes the water valve to open and allows the inflow of water from a water supply, e.g., the public water mains. As the water pours into the container, the shuttle on the volume sensor starts to rise. The shuttle has an earth signal from the digital electronic volume/flow control sensor circuitry connected to it. As the sweeping conductive brush on the shuttle makes contact with the contact that corresponds to selected VOLUME LEVEL button and/or switch pushed on the outside of the water storage tank, the earth signal causes the digital electronic volume/flow control sensor circuitry to turn off the water valve.

This closes the inflow of water from the water supply and simultaneously turns on the motor. The motor can be preset with a predetermined amount of time to cause the output shaft to rotate in the clockwise direction, and to cause the output shaft to rotate in the counter-clockwise direction. As the motor rotates in the clockwise direction, the gear raises the plunger element, thus letting the water out of the container to flush. The digital electronic volume/flow control sensor circuitry then reverses the polarity of the current to the motor and causes the output shaft to rotate in the counter-clockwise direction to lower the plunger element and seal the container again. Until the next activation, the container remains empty.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
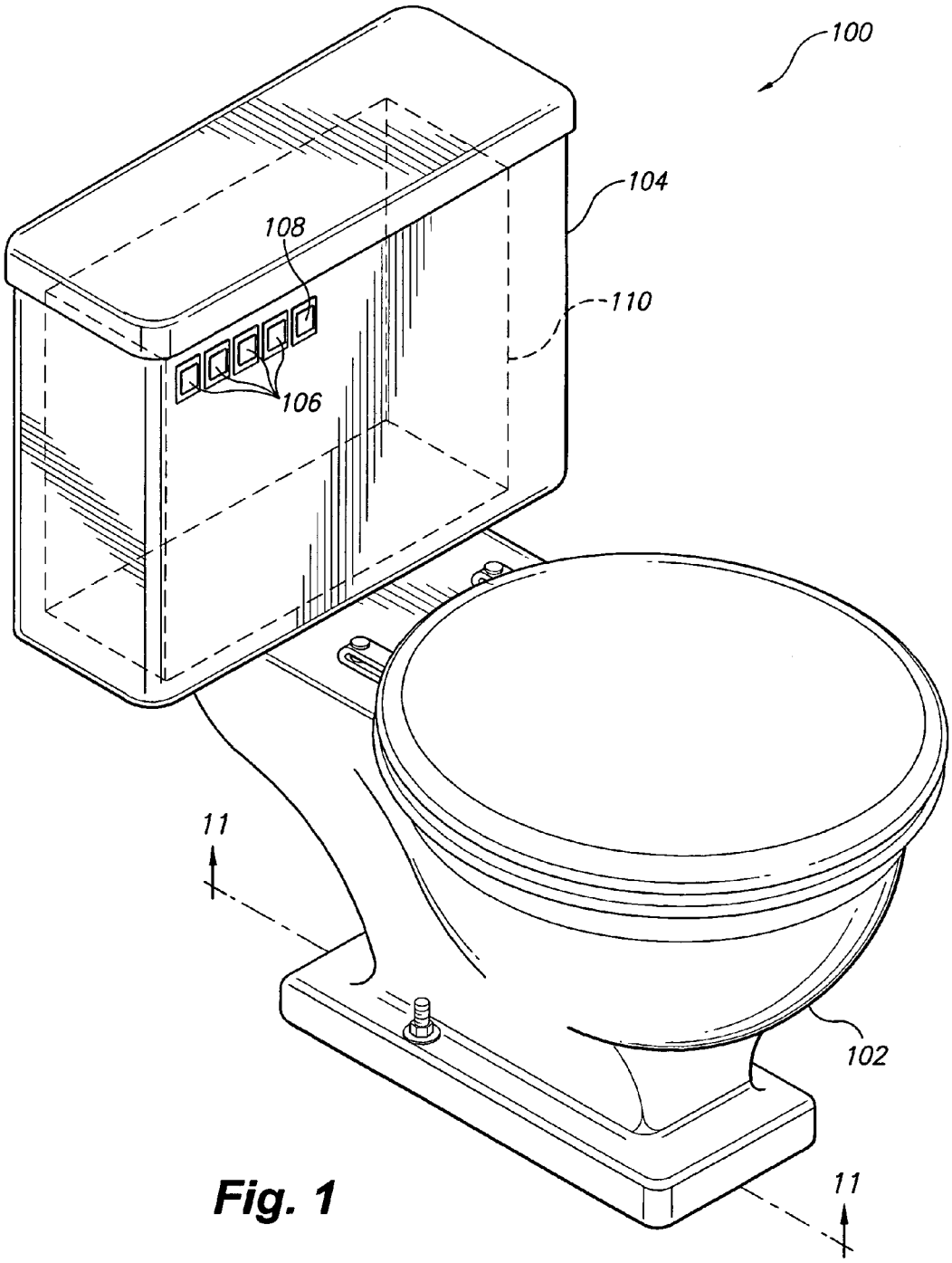
FIG. 1 is a perspective view of a digital electronic volume/flow control sensor toilet according to the present invention.

The present invention is a digital electronic volume/flow control sensor toilet. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

Referring to the drawings, FIGS. 1–11 show various digital electronic volume/flow control sensor components of a digital electronic volume/flow control sensor toilet 100 according to the present invention. It is the full intent of the inventor that the digital electronic volume/flow control sensor components described herein may either be fully integrated in a newly manufactured toilet or utilized to retrofit an existing toilet. The components themselves may be provided to users as a kit for retrofitting an existing toilet with accompanying guides and/or instructions as desired.

The digital electronic volume/flow control sensor toilet 100 includes a bowl 102 through which water passes to receive and remove matter, a water storage tank 104 interconnected with the bowl to replenish water after the flushing has emptied the bowl, and a digital electronic volume/flow control sensor flushing mechanism 110. The digital electronic volume/flow control sensor flushing mechanism 110 has digital electronic volume/flow control sensor components including a volume sensor 120, a shuttle 130, a plunger assembly 140, a motor 150, a water valve 160, and a control 170 with a power source and digital electronic volume/flow control sensor circuitry communicatively interconnecting the digital electronic volume/flow control sensor components.

The flushing mechanism 110 has a container preferably configured in the form of a generally rectangular box with a lower end, an upper end and four sides interconnecting the lower end and upper end. The ends and sides are preferably formed of a durable, water resistant material, such as plastic or the like. The material may be transparent, translucent and/or opaque with coloring as desired. The lower end of the container has a generally circular aperture defined therein with a generally cylindrically threaded end protruding therefrom. The threaded end is configured to releasably engage with a threaded anchor nut interconnected with the water storage tank of the digital electronic volume/flow control sensor toilet 100.

The volume sensor 120 is an elongated generally rectangular element with an upper end, a lower end, two sides, and an elongated recess on one of the two sides. The lower end of the volume sensor 120 has a footing removably attachable to the lower end of the container of the flushing mechanism 110 by appropriate fasteners which may be screws, nails, tacks, bolts, nuts, adhesives, or the like. A plurality of electrically conductive contact points are exposed on the surface and along the length of the side of the volume sensor 120 with the recess. Positions of the contact points correspond to predetermined volume levels of the container. A plurality of VOLUME SELECTION buttons/switches 106 can be associated with the contact points and can be mounted on the outer surface of the water storage tank 104 of the toilet 100. These VOLUME SELECTION buttons/switches 106 may include appropriate indicia in the form of alphanumeric characters, icons, symbols, etc., and may be provided with a desired color and/or Braille to accommodate particular users.

An additional HOLD button/switch 108 can also mounted on the outer surface of the water storage tank. The HOLD button/switch 108, when activated by a user in combination with one of the VOLUME SELECTION buttons/switches 106, causes water to fill the container of the flushing mechanism 110 to the volume associated with the selected VOLUME SELECTION button/switch 106. Electrical leads are interconnected to the contact points and are sealed within the volume sensor 120. These electrical leads pass through and emerge from the top of the volume sensor 120. The volume sensor 120 passes through the shuttle 130. As an alternative to the volume selection button/switch 106 and hold button/switch 108, a load sensor can be interconnected with the volume sensor 120 to automatically sense a load and cause water to fill the container of the flushing mechanism 110 to the volume associated with the amount of load sensed by the load sensor.

The shuttle 130 is configured to slidably move up and down along the volume sensor 120 via appropriately shaped apertures defined through the top and bottom of the shuttle 130. The shuttle 130 is preferably made of a water resistant, easily floating material. The apertures are configured to effectively mesh with the contour of the volume sensor 120. The shuttle 130 includes a spring-type electrically conductive brush that makes constant contact with the surface of the volume sensor 120 as the shuttle 130 moves up and down the volume sensor 130. An electrical lead is interconnected with the brush. When the container is empty, the shuttle rests at the bottom of the volume sensor 120. When water fills the container, the shuttle 130 moves up and floats on the surface of the water. When the shuttle 130 passes each of the contacts on the volume sensor, a signal corresponding to volume levels associated with the contacts is provided to the digital electronic volume/flow control sensor circuitry in the control 170.

The plunger assembly 140 is an elongated rod with a top end and a bottom end. The rod is preferably made of durable material, such as metal, plastic, or the like. A water sealing plunger element is attached to the bottom end of the rod. The water sealing plunger element is preferably made of flexible water resistant material, such as rubber or the like. A straight gear ratchet is attached to the top end of the rod and is configured to interact with a gear on the motor 150. The plunger assembly 140 moves up and down and causes the plunger element to open and close the circular aperture at the lower end of the container. When the plunger element is open the container release any water contained therein, and when the plunger element is closed the container can be filled with water.

Figure 2:
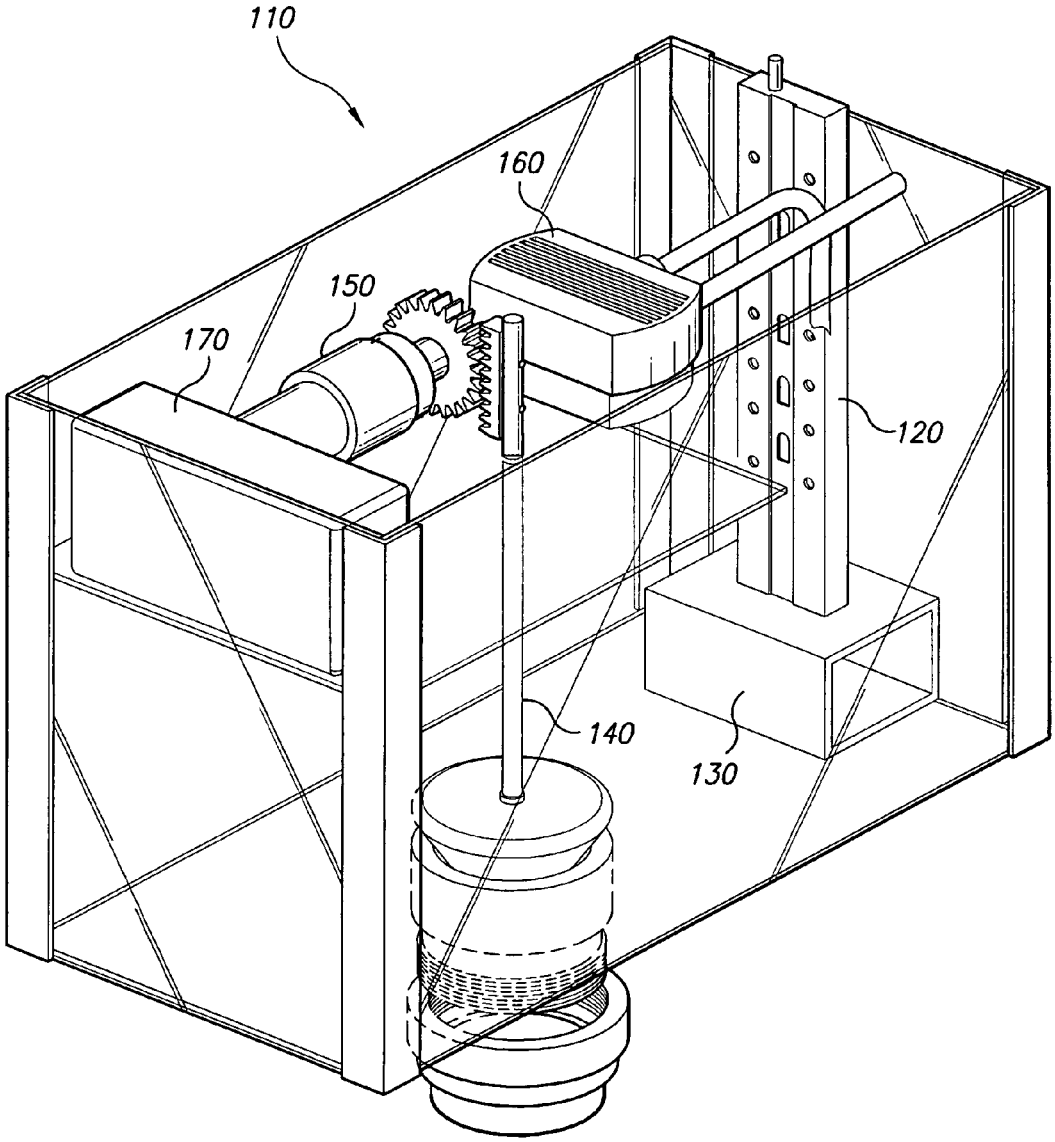
FIG. 2 is a front perspective view of the flushing mechanism of a digital electronic volume/flow control sensor toilet according to the present invention.
Figure 3:
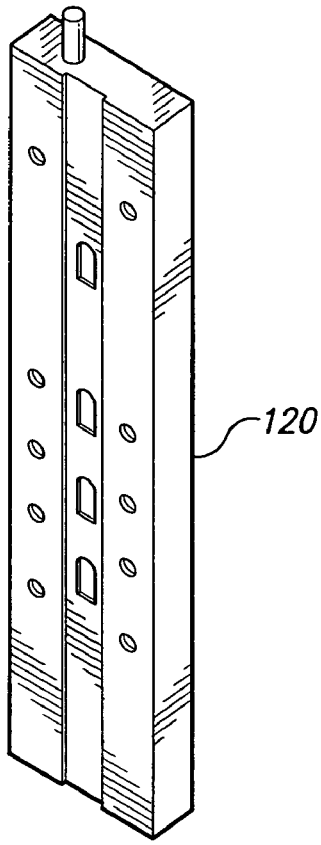
FIG. 3 is a front perspective view of a volume sensor of a flushing mechanism of a digital electronic volume/flow control sensor toilet according to the present invention.
Figure 4:
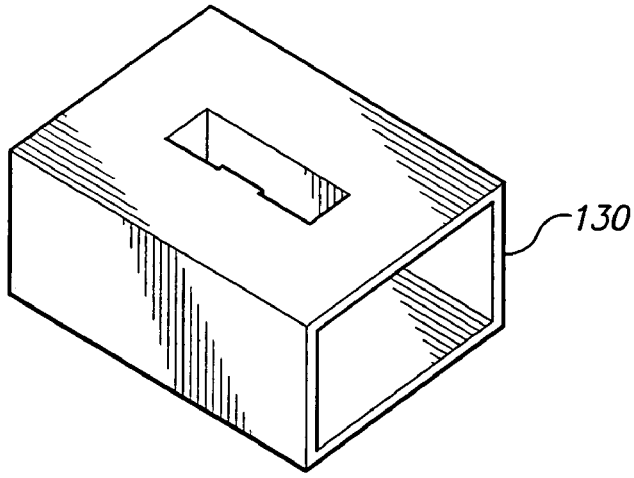
FIG. 4 is a front perspective view of a shuttle of a flushing mechanism of a digital electronic volume/flow control sensor toilet according to the invention.
Figure 5:
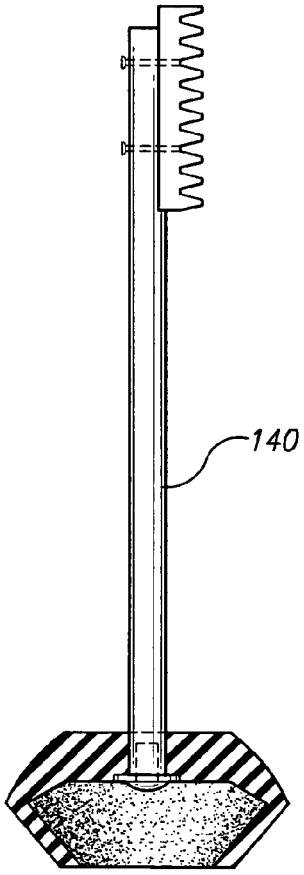
FIG. 5 is a front view of a plunger assembly of a flushing mechanism of a digital electronic volume/flow control sensor toilet according to the present invention.
Figure 6:
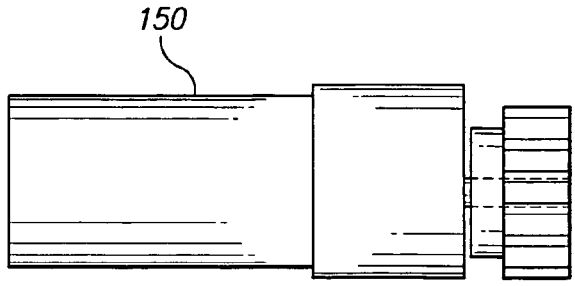
FIG. 6 is a front view of a motor of a flushing mechanism of a digital electronic volume/flow control sensor toilet according to the present invention.
Figure 7:
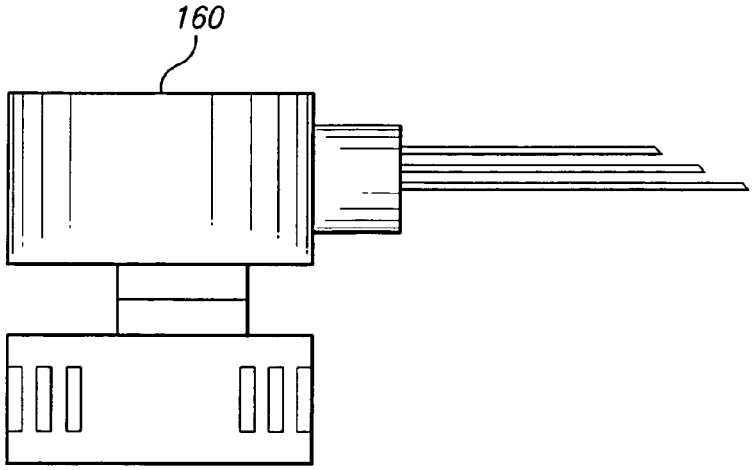
FIG. 7 is a side view of a water valve of a flushing mechanism of a digital electronic volume/flow control sensor toilet according to the present invention.
Figure 8:
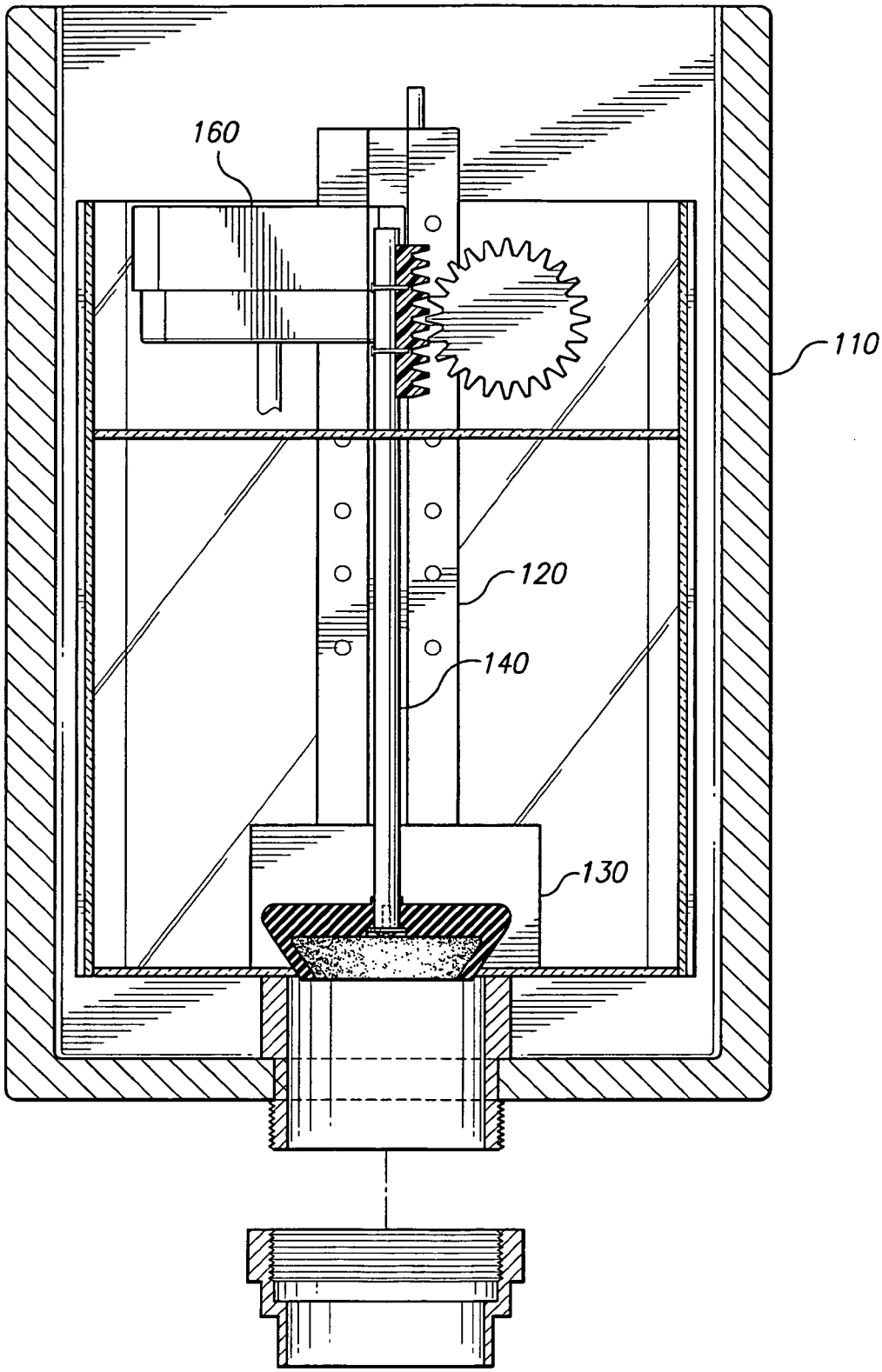
FIG. 8 is a cross sectional view of a water storage tank of a digital electronic volume/flow control sensor toilet according to the present invention.
Figure 9:
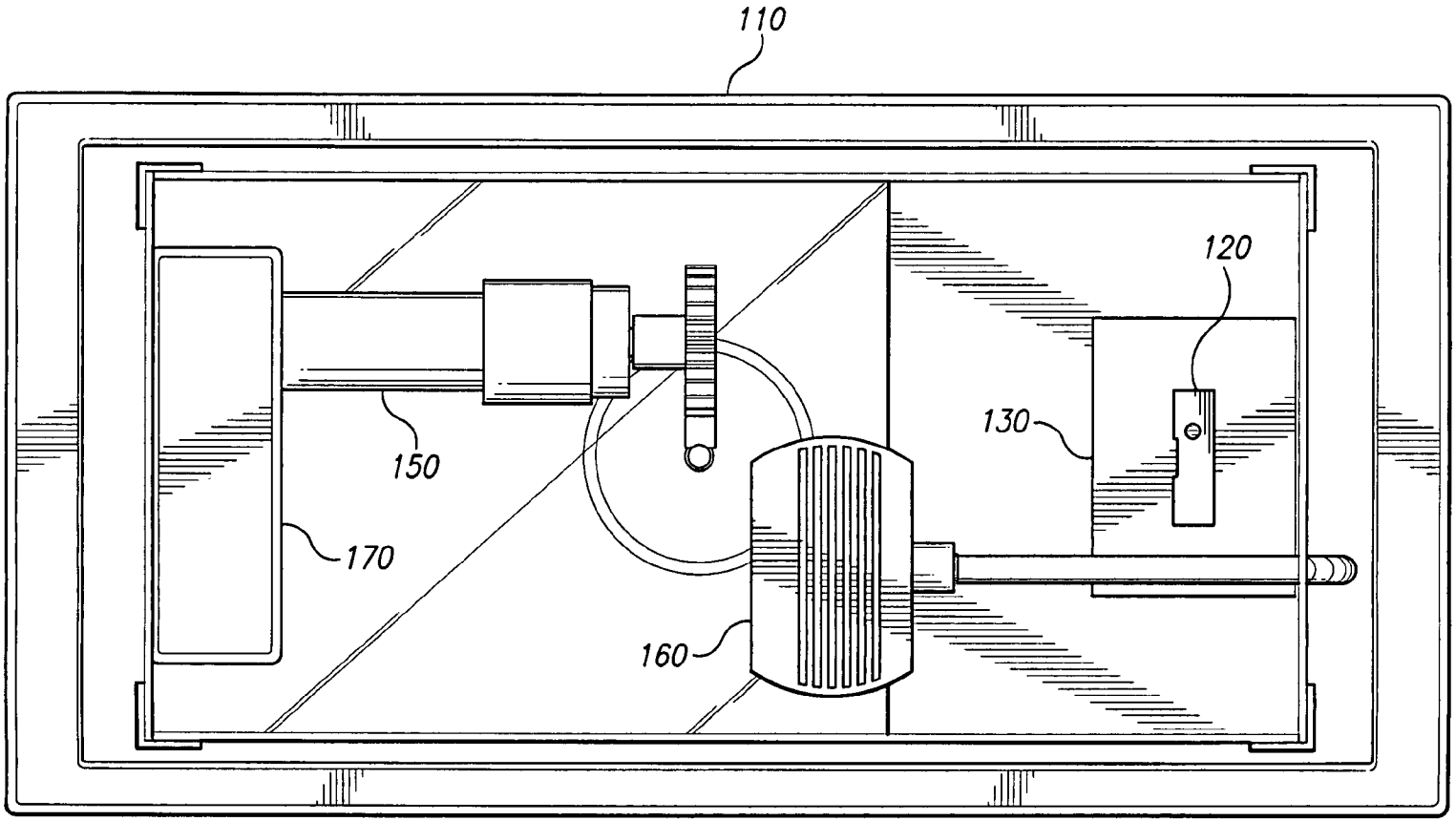
FIG. 9 is a top view of a water storage tank of a digital electronic volume/flow control sensor toilet according to the present invention.

The motor 150 is preferably a reversible DC electric motor, such as six volts or the like. The motor 150 has two ends with a rotatable shaft extending from one end with a gear attached thereto. Wiring is attached to the other end and is configured to electrically interconnect the motor 150 with a power source. Referring to FIG. 2, when the shaft rotates in the clockwise direction, the gear on the output shaft causes the gear ratchet on the plunger assembly 140 to move up, thereby opening the plunger element. When the shaft rotates in the counter-clockwise direction, the gear on the output shaft causes the gear ratchet on the plunger assembly 140 to move down, thereby closing the plunger element. The motor 150 may be configured with predetermined settings to stop the motor 150 when the gear on the output shaft rotates a predetermined amount in the clockwise direction and/or when the output shaft rotates a predetermined amount in the counter-clockwise direction. These particular settings may be varied as desired.

Figure 10:
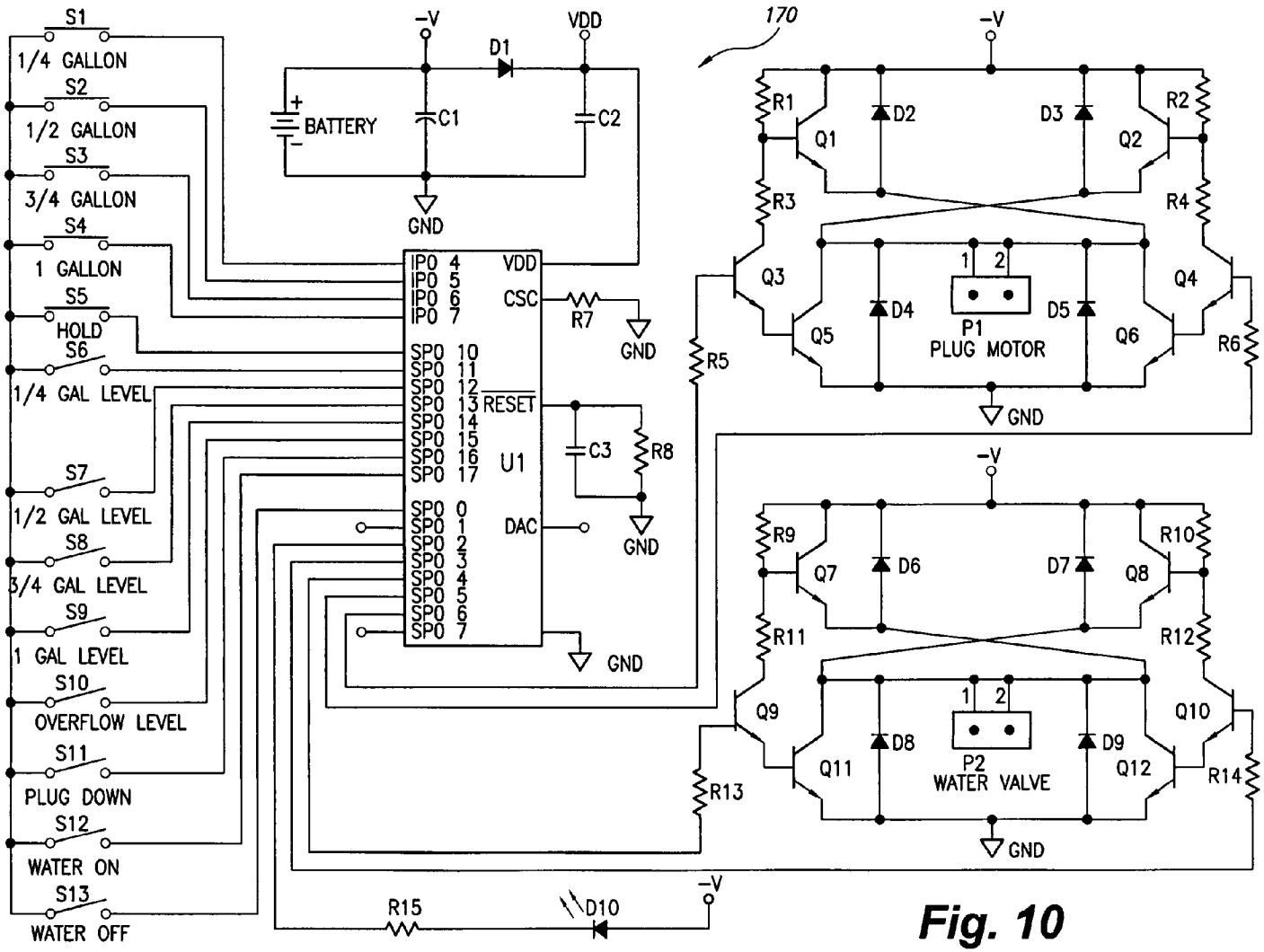
FIG. 10 is a top view of a water storage tank of a digital electronic volume/flow control sensor toilet according to the present invention.

The water valve 160 is preferably a DC electric water valve 160. The water valve 160 is electrically interconnected with the VOLUME LEVEL buttons/switches 106 on the outer surface of the water storage tank. The control 170 includes digital electronic volume/flow control sensor circuitry and a power source. FIG. 10 illustrates one example of digital electronic volume/flow control sensor circuitry that may be used with the digital electronic volume/flow control sensor toilet 100. The power source may be a chargeable and/or non-chargeable battery. Alternatively, the control 170 may be configured for receiving power from an external power source, such as utility power, and converting such power to a DC voltage level suitable for driving the components in the digital electronic volume/flow control sensor circuitry.

When one of the VOLUME LEVEL buttons/switches 106 on the water storage tank is activated or when a load sensor interconnected with the volume sensor 120 senses an amount of load, the control 170 causes the water valve 160 to open and allows the inflow of water from a water supply, e.g., the public water mains. As the water pours into the container, the shuttle 130 on the volume sensor 120 starts to rise. The shuttle 130 has an earth signal from the digital electronic volume/flow control sensor circuitry connected to it. As the sweeping conductive brush on the shuttle 130 makes contact with the contact that corresponds to the selected VOLUME LEVEL button/switch 106 pushed on the outside of the water storage tank 104 or the amount of load sensed by a load sensor, the earth signal causes the digital electronic volume/flow control sensor circuitry to turn off the water valve 160.

This closes the inflow of water from the water supply and simultaneously turns on the motor 150. The motor 150 can be preset with a predetermined amount of time to cause the output shaft to rotate in the clockwise direction, and to cause the output shaft to rotate in the counter-clockwise direction. As the motor 150 rotates in the clockwise direction, the gear raises the plunger element, thus letting the water out of the container to flush. The digital electronic volume/flow control sensor circuitry then reverses the polarity of the current to the motor 150 and causes the output shaft to rotate in the counter-clockwise direction to lower the plunger element and seal the container again. Until the next activation, the container remains empty.

As previously described, one of the button/switches on the water storage tank is a HOLD button 108. Whenever one of the other four VOLUME LEVEL button/switches 106 is activated, and the HOLD button/switch 108 is also activated, water fills the container to the selected volume level with the water valve 160. Inflow from the water supply mains then stops, but the ripple-through action in the digital electronic volume/flow control sensor circuit stops. In other words, the motor 150 does not proceed to activate to raise the plunger element until any one of the VOLUME LEVEL button/switches 106 or the HOLD button/switch 108 is again pressed to activate the motor 150 and raise the plunger element, thereby resulting in an instant flush.

A circuit diagram of an example of digital electronic volume/flow control sensor circuitry 170 is shown in FIG. 10. The digital electronic volume/flow control sensor circuitry 170 may be configured in various ways to perform substantially the same function in substantially the same manner to achieve substantially the same results. For example, while the illustrated digital electronic volume/flow control sensor circuitry 170 includes discrete components, economic circumstances may result in much or all of the digital electronic volume/flow control sensor circuitry 170 being constructed as one or more integrated circuits. As illustrated, the digital electronic volume/flow control sensor circuit elements are preferably, but not limited to:

| Component | Part Number or rating |
|---|---|
| C1 | 22 uF capacitor |
| C2 | 0.1 uF capacitor |
| C3 | 0.1 uF capacitor |
| D1 | 1N4002 diode |
| D2 | 1N4002 diode |
| D3 | 1N4002 diode |
| D4 | 1N4002 diode |
| D5 | 1N4002 diode |
| D6 | 1N4002 diode |
| D7 | 1N4002 diode |
| D8 | 1N4002 diode |
| D9 | 1N4002 diode |
| D10 | Green LED diode |
| P1 | Plug Motor |
| P2 | Water Valve |
| Q1 | 8550 transistor |
| Q2 | 8550 transistor |
| Q3 | 8050 transistor |
| Q4 | 8050 transistor |
| Q5 | 8050 transistor |
| Q6 | 8050 transistor |
| Q7 | 8550 transistor |
| Q8 | 8550 transistor |
| Q9 | 8050 transistor |
| Q10 | 8050 transistor |
| Q11 | 8050 transistor |
| Q12 | 8050 transistor |
| Q13 | 8050 transistor |

-continued

| Component | Part Number or rating |
|---|---|
| R1 | 100 Kohms resistor |
| R2 | 100 Kohms resistor |
| R3 | 100 Kohms resistor |
| R4 | 100 Kohms resistor |
| R5 | 1 Kohms resistor |
| R6 | 1 Kohms resistor |
| R7 | 300 Kohms resistor |
| R8 | 100 Kohms resistor |
| R9 | 100 Kohms resistor |
| R10 | 100 Kohms resistor |
| R11 | 100 Kohms resistor |
| R12 | 100 Kohms resistor |
| R13 | 1 Kohms resistor |
| R14 | 1 Kohms resistor |
| R15 | 220 ohms resistor |
| S1 | ¼ Gallon switch |
| S2 | ½ Gallon switch |
| S3 | ¾ Gallon switch |
| S4 | 1 Gallon switch |
| S5 | Hold switch |
| S6 | ¼ Gallon Level switch |
| S7 | ½ Gallon Level switch |
| S8 | ¾ Gallon Level switch |
| S9 | 1 Gallon Level switch |
| S10 | Overflow Level switch |
| S11 | Plug Down switch |
| S12 | Water On switch |
| S13 | Water Off switch |
| S1 | ¼ Gallon switch |
| U1 | Winbond W567B010 processor |

Figure 11:
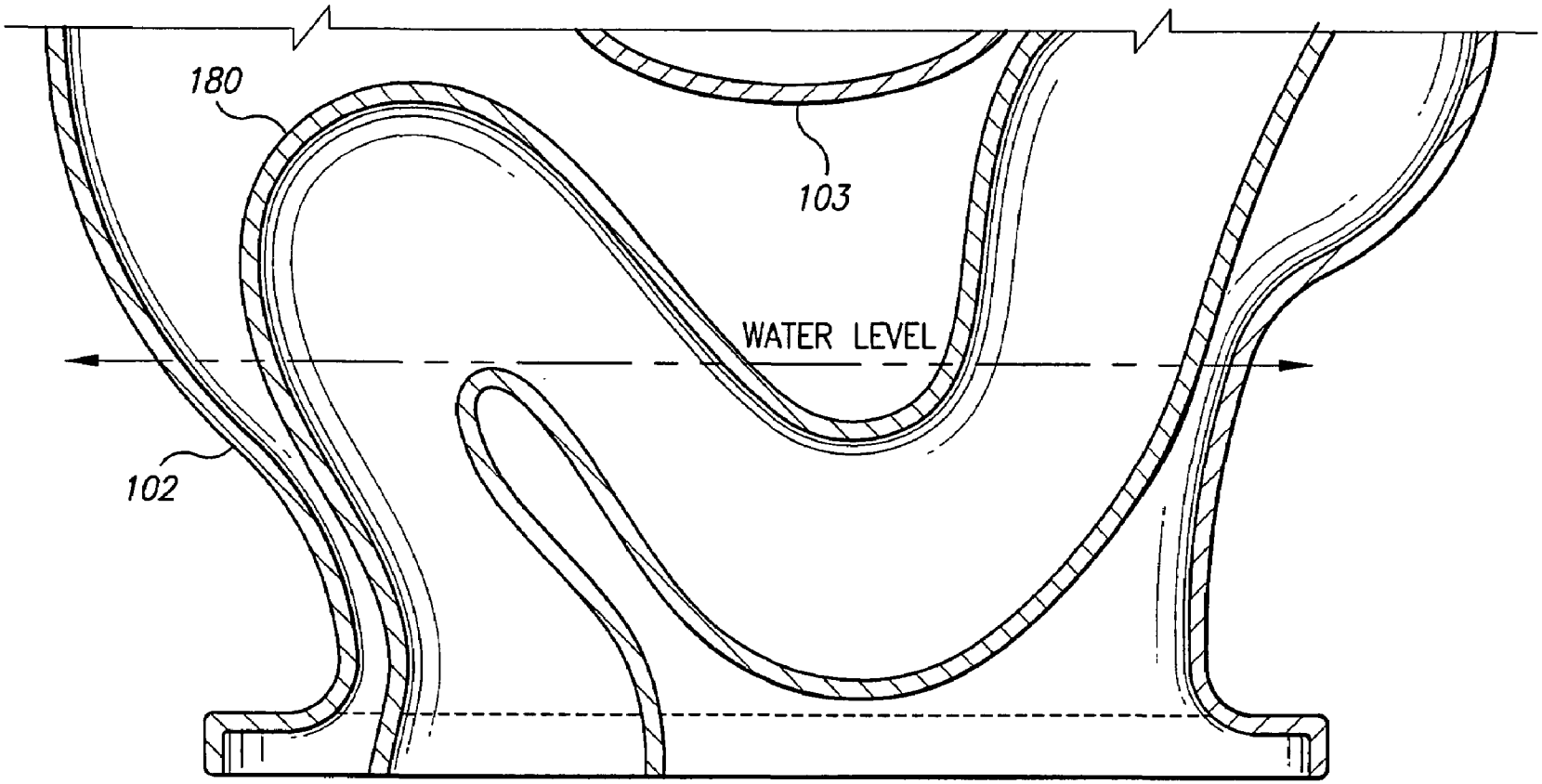
FIG. 11 is a sectional view of toilet bowl of the digital electronic volume/flow control sensor toilet shown in FIG. 1.

FIG. 11 shows a generally U-shaped drain pipe 180 that is connected to the basin 103 of the toilet bowl 102. Prior to usage of the toilet bowl 102, the basin is empty and a small quantity of water resides in the drain pipe 180 at the bottom of the U-shaped portion of the pipe 180. When the flushing mechanism is activated, the water in the container 110 empties into the toilet bowl 102 and empties the basin 103, resulting in a small quantity of water residing at the bottom of the U-shaped portion of the pipe 180.

As previously described, the digital electronic volume/flow control sensor components described herein may either be fully integrated in a newly manufactured toilet or utilized to retrofit an existing toilet. The components themselves may be provided to users as a kit for retrofitting an existing toilet with accompanying guides and/or instructions as desired.

In summary, the digital electronic volume/flow control sensor toilet 100 includes a bowl through which water passes to receive and remove matter, a water storage tank interconnected with the bowl to replenish water after flushing has emptied the bowl, and a digital electronic volume/flow control sensor flushing mechanism 110. The digital electronic volume/flow control sensor flushing mechanism 110 has digital electronic volume/flow control sensor components including a volume sensor 120, a shuttle 130, a plunger assembly 140, a motor 150, a water valve 160, and a control 170 with a power source and digital electronic volume/flow control sensor circuitry communicatively interconnecting the digital electronic volume/flow control sensor components.

The digital electronic volume/flow control sensor toilet 100 includes a container with a lower end, an upper end and four sides interconnecting the lower end and the upper end. The ends and sides are formed of a durable, water resistant material. The volume sensor 120 is an elongated generally rectangular element with an upper end, a lower end, two sides, and an elongated recess on one of the two sides. The volume sensor 120 has a plurality of electrically conductive contact points exposed on a surface and at positions along a length of the side of the volume sensor with the recess, the positions of the contact points corresponding to predetermined volume levels of the container. A plurality of VOLUME SELECTION buttons/switches 106 can be mounted on an outer surface of the water storage tank, the VOLUME SELECTION buttons/switches 106 being associated with the contact points.

The VOLUME SELECTION buttons/switches 106 can include indicia. A HOLD button/switch 108 can be mounted on the outer surface of the water storage tank, wherein the HOLD button/switch 108, when activated by a user in combination with one of the VOLUME SELECTION buttons/switches 106, causes water to fill the container to the volume associated with the selected VOLUME SELECTION button/switch 106. The shuttle 130 is configured to slidably move up and down along the volume sensor 120 via appropriately shaped apertures defined through a top and bottom of the shuttle 130. As an alternative to the volume selection button and/or switch 106 and hold button/switch 108, a load sensor can be interconnected with the volume sensor 120 to automatically sense a load and cause water to fill the container of the flushing mechanism 110 to the volume associated with the amount of load sensed by the load sensor.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A digital electronic volume/flow control sensor flushing mechanism for use with a digital electronic volume/flow control sensor toilet, said digital electronic volume/flow control sensor flushing mechanism having digital electronic volume/flow control sensor components comprising:

a volume sensor including an elongated generally rectangular element with an upper end a lower end, two sides and an elongated recess on one of the two sides;

a shuttle;

a plunger assembly;

a motor;

a water valve; and a control with a power source and digital electronic volume/flow control sensor circuitry communicatively interconnecting the digital electronic volume/flow control sensor components.

2. The digital electronic volume/flow control sensor flushing mechanism according to claim 1, further comprising a container with a lower end, an upper end and four sides interconnecting the lower end and the upper end.

3. The digital electronic volume/flow control sensor flushing mechanism according to claim 2, wherein said ends and sides are formed of a durable, water resistant material.

4. The digital electronic volume/flow control sensor flushing mechanism according to claim 2, wherein said volume sensor has a plurality of electrically conductive contact points exposed on a surface and at positions along a length of the side of the volume sensor with the recess, the positions of the contact points corresponding to predetermined volume levels of the container.

5. The digital electronic volume/flow control sensor flushing mechanism according the claim 4, in combination with a digital electronic volume/flow control sensor toilet having a bowl through which water passes to receive and remove matter, and a water storage tank interconnected with the bowl to replenish water after flushing has emptied the bowl, said digital electronic volume/flow control sensor flushing mechanism further comprising a plurality of VOLUME SELECTION buttons/switches mounted on an outer surface of the water storage tank, the VOLUME SELECTION buttons/switches being associated with the contact points.

6. The digital electronic volume/flow control sensor flushing mechanism according the claim 5, wherein said VOLUME SELECTION buttons/switches include indicia.

7. The digital electronic volume/flow control sensor flushing mechanism according the claim 5, further comprising a HOLD button/switch mounted on the outer surface of the water storage tank, wherein the HOLD button/switch, when activated by a user in combination with one of the VOLUME SELECTION buttons and/or switches, causes water to fill the container to the volume associated with the selected VOLUME SELECTION button/switch.

8. The digital electronic volume/flow control sensor flushing mechanism according the claim 4, wherein said shuttle is configured to slidably move up and down along the volume sensor via appropriately shaped apertures defined through a top and bottom of the shuttle.

9. The digital electronic volume/flow control sensor flushing mechanism according the claim 4, wherein said motor is a reversible DC electric motor.

10. A digital electronic volume/flow control sensor toilet comprising:

a bowl through which water passes to receive and remove matter;

a water storage tank interconnected with the bowl to replenish water after flushing has emptied the bowl;

a digital electronic volume/flow control sensor flushing mechanism having digital electronic volume/flow control sensor components comprising:

a volume sensor including an elongated generally rectangular element with an upper end, a lower end, two sides and an elongated recess on one of the two sides;

a shuttle;

a plunger assembly;

a motor;

a water valve: and a control with a power source and digital electronic volume/flow control sensor circuitry communicatively interconnecting the digital electronic volume/flow control sensor components; and a container with a lower end, an upper end and four sides interconnecting the lower end and the upper end.

11. The digital electronic volume/flow control sensor toilet according to claim 10, wherein said ends and sides are formed of a durable, water resistant material.

12. The digital electronic volume/flow control sensor toilet according to claim 10, wherein said volume sensor has a plurality of electrically conductive contact points exposed on a surface and at positions along a length of the side of the volume sensor with the recess, the positions of the contact points corresponding to predetermined volume levels of the container.

13. The digital electronic volume/flow control sensor toilet according the claim 12, further comprising a plurality of VOLUME SELECTION buttons/switches mounted on an outer surface of the water storage tank, the VOLUME SELECTION buttons/switches being associated with the contact points.

14. The digital electronic volume/flow control sensor toilet according the claim 13, wherein said VOLUME SELECTION buttons/switches include indicia.

15. The digital electronic volume/flow control sensor toilet according the claim 12, further comprising a HOLD button/switch mounted on the outer surface of the water storage tank, wherein the HOLD button/switch, when activated by a user in combination with one of the VOLUME SELECTION buttons and/or switches, causes water to fill the container to the volume associated with the selected VOLUME SELECTION button/switch.

16. The digital electronic volume/flow control sensor toilet according the claim 10, wherein said shuttle is configured to slidably move up and down along the volume sensor via appropriately shaped apertures defined through a top and bottom of the shuttle.

* * * * *